US006484788B1

(12) United States Patent
Jerrell et al.

(10) Patent No.: US 6,484,788 B1
(45) Date of Patent: Nov. 26, 2002

(54) SELF-LOCKING CURTAIN CLIP

(75) Inventors: Marijean Jerrell, New York, NY (US); Jamie P. Falkenburg, New York, NY (US); David Breslof, New York, NY (US)

(73) Assignee: Town & Country Living, New York, NY (US)

( * ) Notice: Subject to any disclaimer, the term of this patent is extended or adjusted under 35 U.S.C. 154(b) by 0 days.

(21) Appl. No.: 09/539,115

(22) Filed: Mar. 30, 2000

(51) Int. Cl.[7] ..... A47H 13/01

(52) U.S. Cl. ..... 160/330; 16/87.2

(58) Field of Search ..... 160/330, 123, 160/341, DIG. 6, 348; 16/87.2, 87.4 R; 4/558, 608

(56) References Cited

U.S. PATENT DOCUMENTS

| | | | | | |
|---|---|---|---|---|---|
| 272,772 | A | | 2/1883 | Reiger | |
| 609,179 | A | | 8/1898 | Bogel | |
| 996,886 | A | * | 7/1911 | Schneider | 16/87.4 R X |
| 1,109,283 | A | | 9/1914 | Elmore | |
| 1,149,628 | A | * | 8/1915 | Byron | 16/87.4 R X |
| 1,160,573 | A | * | 11/1915 | Byron | 16/87.4 R X |
| 1,395,350 | A | | 11/1921 | Oberst | |
| 1,478,820 | A | * | 12/1923 | Dwyer | 16/87.4 R X |
| 1,575,079 | A | * | 3/1926 | Reinhardt | 16/87.2 X |
| 2,070,046 | A | | 2/1937 | Gredell | |
| 2,131,156 | A | | 9/1938 | Yardley | |
| 2,320,308 | A | * | 5/1943 | Silverman | 160/330 |
| 2,585,500 | A | | 2/1952 | Roy | |
| 2,711,555 | A | * | 6/1955 | Hanson | 16/87.2 |
| 3,235,928 | A | | 2/1966 | Clark | |
| 3,567,062 | A | | 3/1971 | Reed et al. | |
| 3,772,734 | A | * | 11/1973 | Kimel | 16/87.2 |
| 3,907,344 | A | | 9/1975 | Newlon et al. | |
| 4,010,503 | A | * | 3/1977 | Denton | 16/87.2 |
| 4,706,347 | A | | 11/1987 | Lindsay | |
| 5,052,085 | A | | 10/1991 | Gau | |
| 5,595,331 | A | | 1/1997 | Leistner | |
| 5,617,616 | A | | 4/1997 | Cutts, Sr. | |
| 5,787,954 | A | * | 8/1998 | Herrera | 160/330 |
| 5,806,141 | A | * | 9/1998 | Kolisch | 16/87.2 |

* cited by examiner

*Primary Examiner*—David M. Purol
(74) *Attorney, Agent, or Firm*—Amster, Rothstein & Ebenstein

(57) ABSTRACT

A self-locking curtain clip for slidably suspending, with like clips, a curtain on an overhead curtain rod, includes a pair of substantially rigid legs defining top ends and bottom ends, the legs being configured and dimensioned to extend cooperatively around a curtain rod and through an aperture in a curtain for suspending the curtain from the rod. A connector pivotally secures the legs together adjacent the top ends, and a spring biases the bottom ends towards one another. Automatic fasteners are provided for locking the bottom ends together when the clip suspends a curtain and for unlocking the bottom ends when the clip is not suspending a curtain, as are manually operable wings for overcoming the biasing spring to spread the bottom ends apart when the bottom ends are not locked together.

13 Claims, 4 Drawing Sheets

FIG. 1
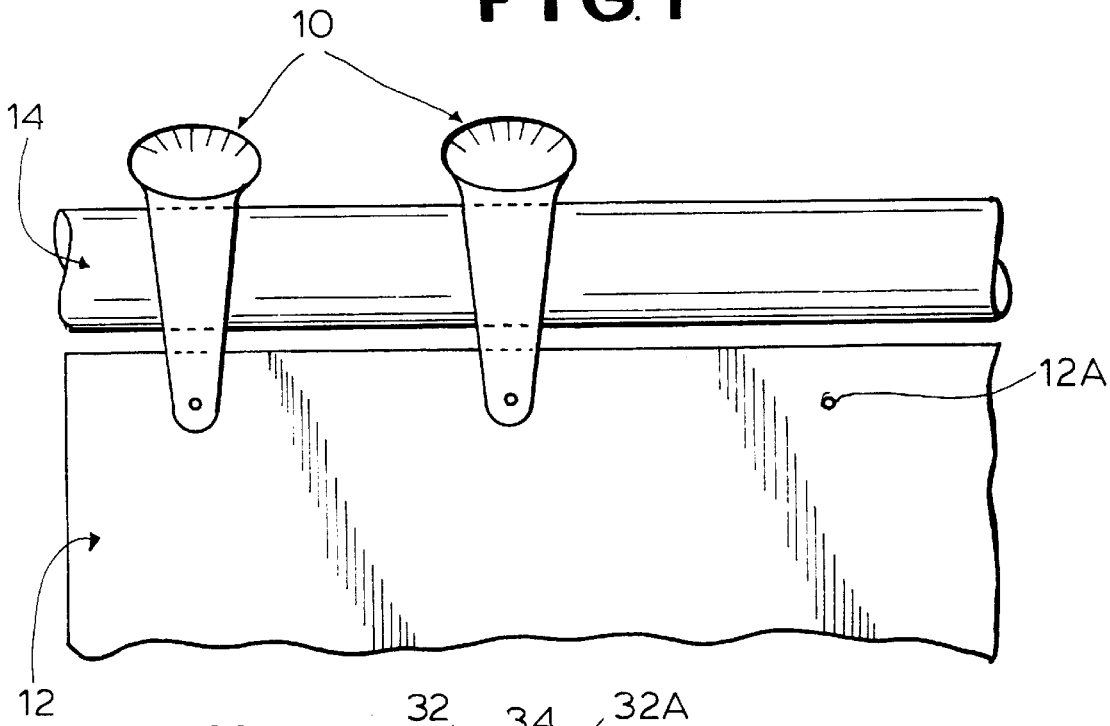
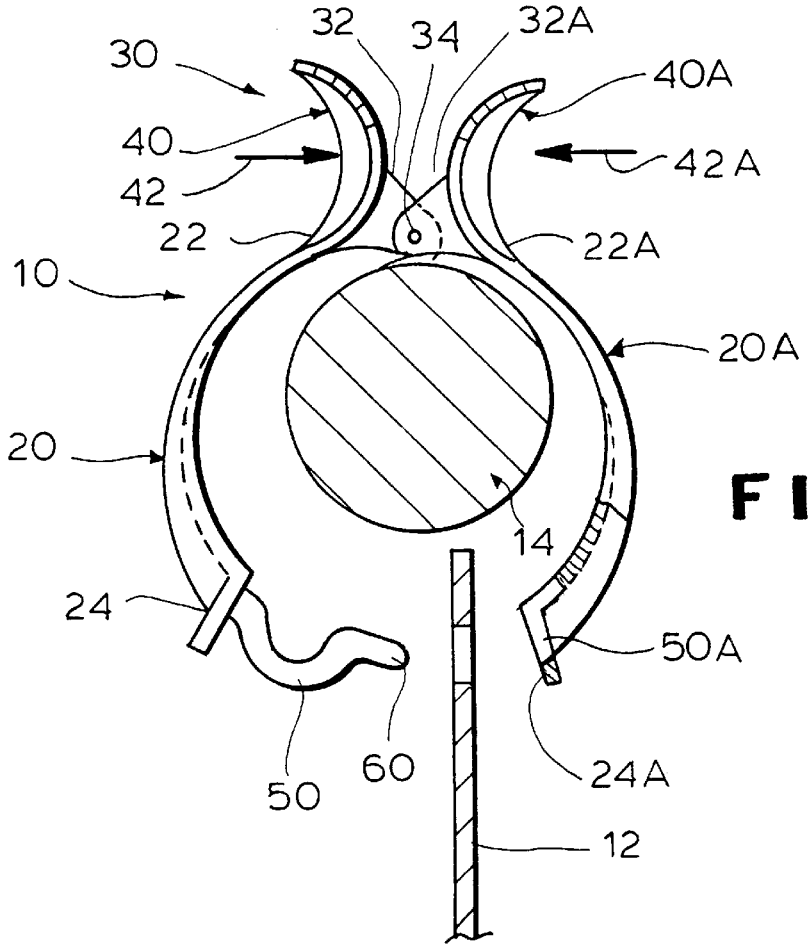
FIG. 2

FIG. 5
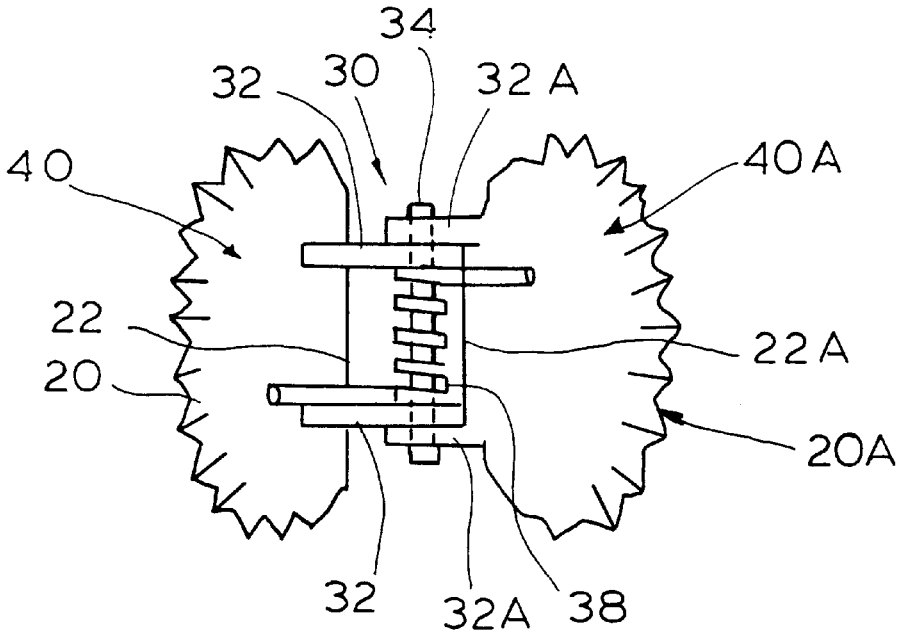
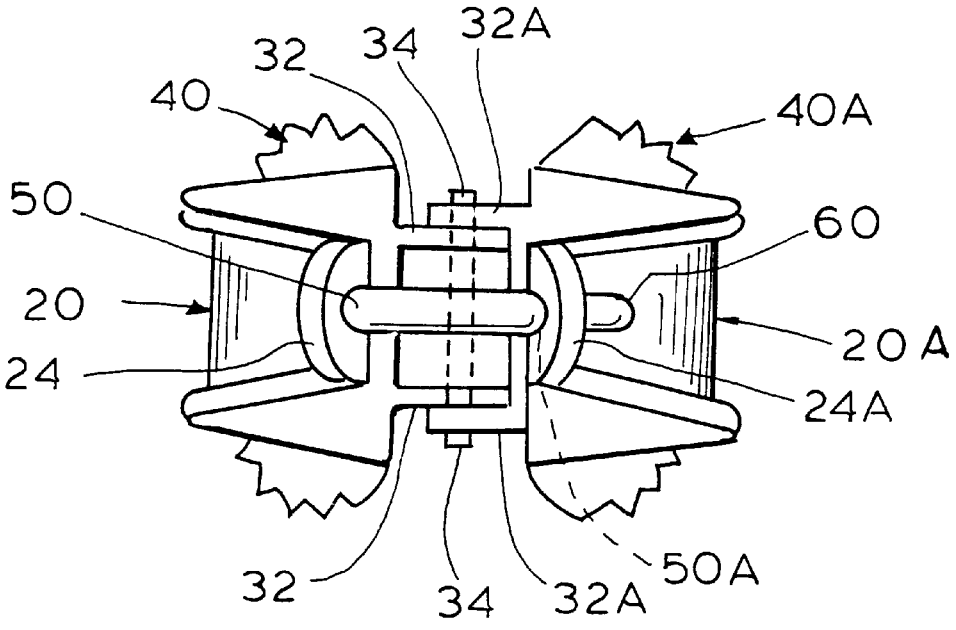
FIG. 6

SELF-LOCKING CURTAIN CLIP

BACKGROUND OF THE INVENTION

The present invention relates to a self-locking curtain clip for slidably suspending, with like clips, a curtain on an overhead curtain rod, and in particular to a self-locking shower curtain clip for slidably suspending, with like clips, a shower curtain on an overhead shower curtain rod.

Curtain clips for slidably suspending, with like clips, a curtain on an overhead curtain rod are well known in the curtain art. In general, such clips comprise a pair of legs defining top ends and bottom ends, the legs being configured and dimensioned to extend cooperatively around the curtain rod and through a respective aperture in a curtain for suspending the curtain from the rod.

In one well-known type of clip, the legs are resiliently flexible and joined together at the top ends. The bottom ends may be forcibly separated in order to allow placement of the clip on a curtain rod and entry of at least one of the bottom ends through a respective aperture in the curtain. This type of curtain clip works well initially, but over time (and these clips may be used for many years) the resilient flexibility of the legs (and in particular legs of plastic) turns to rigidity, and it becomes difficult to remove the clip from the curtain rod or even to open the clip sufficiently to enable replacement of the curtain.

In another well-known type of clip, the legs are substantially rigid. In this case, means are provided adjacent the top ends for securing the top ends of the legs together and for biasing the bottom ends of the legs towards one another. Means are preferably provided for manually locking the bottom ends together and for manually unlocking the bottom ends. Manually operable means (such as wings) allow the user to overcome the biasing means and spread the bottom ends apart when the bottom ends are not locked together.

Clips of the second type have not proven to be entirely satisfactory in use. Typically, the person using the clip must take separate actions to lock the bottom ends together (for example, for ordinary use when the clip suspends a curtain from a rod) or to unlock the bottom ends (for example, in order to suspend a curtain from the clip or to place the clip on a curtain rod). In extreme cases, two-handed operation is required, with one hand unlocking the bottom ends in order to enable the bottom ends to be separated and the other hand operating the means for overcoming the bias and spreading the bottom ends apart. As this two-handed operation frequently occurs over the head of the user, it is difficult and tiring to perform for each of the clips being used in unison. Thus the need remains for a clip of the second type which does not require a separate motion on the part of the user to lock or unlock the bottom ends.

Accordingly, it is an object of the present invention in one embodiment to provide a self-locking curtain clip for slidably suspending, with like clips, a curtain on an overhead curtain rod.

Another object is to provide in one embodiment such a curtain clip which is self-unlocking.

A further object is to provide in one embodiment such a curtain clip which is simple and economical to manufacture, use and maintain, the clip being possessed of a long useful life.

SUMMARY OF THE INVENTION

It has now been found that the above and related objects of the present invention are obtained in a self-locking curtain clip for slidably suspending, with like clips, an aperture curtain on an overhead curtain rod. The clip comprises a pair of substantially rigid legs defining top ends and bottom ends, the legs being configured and dimensioned to extend cooperatively about a curtain rod and through an aperture in a curtain for suspending the curtain from the rod. Connecting means pivotally secure the legs together adjacent the top ends. Automatic means are provided for locking the bottom ends together when the clip suspends a curtain and for unlocking the bottom ends when the clip is not suspending a curtain. Manually operable means are provided for spreading the bottom ends apart when the bottom ends are not locked together.

In a preferred embodiment, one of the bottom ends defines first engaging means, preferably a hook, and the other of the bottom ends defines second engaging means, preferably an eyelet. Biasing means bias the bottom ends towards one another. The biasing means acts to inter-engage the first and second engaging means without locking the bottom ends together—in other words, simply by causing the hook to enter the eyelet. However, the hook, when bearing the weight of its proportional share of a curtain suspended therefrom, engages the eyelet in a locked orientation to preclude easy manual separation of the hook and the eyelet, and, when not bearing such weight, engages the eyelet in an unlocked orientation to enable easy manual separation of the hook and the eyelet.

Preferably, the hook is pivotally secured to the one bottom end for movement in a vertical plane relative to the one bottom end such that in a locked orientation the hook is locked together with the eyelet, and in an unlocked orientation the hooked is unlocked and releasable from the eyelet. The hook is pivotal from the unlocked orientation to the locked orientation by the weight of its proportional share of a curtain suspended therefrom. Thus a free end of a hook is movable a vertically extending distance between an upper unlocked orientation and a lower locked orientation. Preferably the hook is resiliently flexible and, in the absence of pressure thereon, maintains the upper unlocked orientation.

The present invention is particularly useful as a shower curtain clip for slidably suspending, with like clips, a shower curtain on an overhead shower curtain rod.

The present invention additionally encompasses, in combination, the clip, a curtain, and a curtain rod.

BRIEF DESCRIPTION OF THE DRAWING

The above and related objects, features, and advantages of the present invention will be more fully understood by reference to the following detailed description of the presently preferred, albeit illustrative, embodiments of the present invention, when taken in conjunction with the accompanying drawing wherein:

FIG. 1 is a fragmentary front elevational view of a clip according to the present invention, as used to suspend a curtain from a curtain rod;

FIG. 2 is a side elevational view, partially in section and to a slightly enlarged scale, of the clip in an open and unlocked orientation, with a shower curtain being fragmentarily indicated between the clip bottom ends;

FIGS. 4, 5 and 6 are views taken along the lines 4—4, 5—5 and 6—6, respectively, of FIG. 3;

DETAILED DESCRIPTION OF THE PREFERRED EMBODIMENTS

Figure 4:
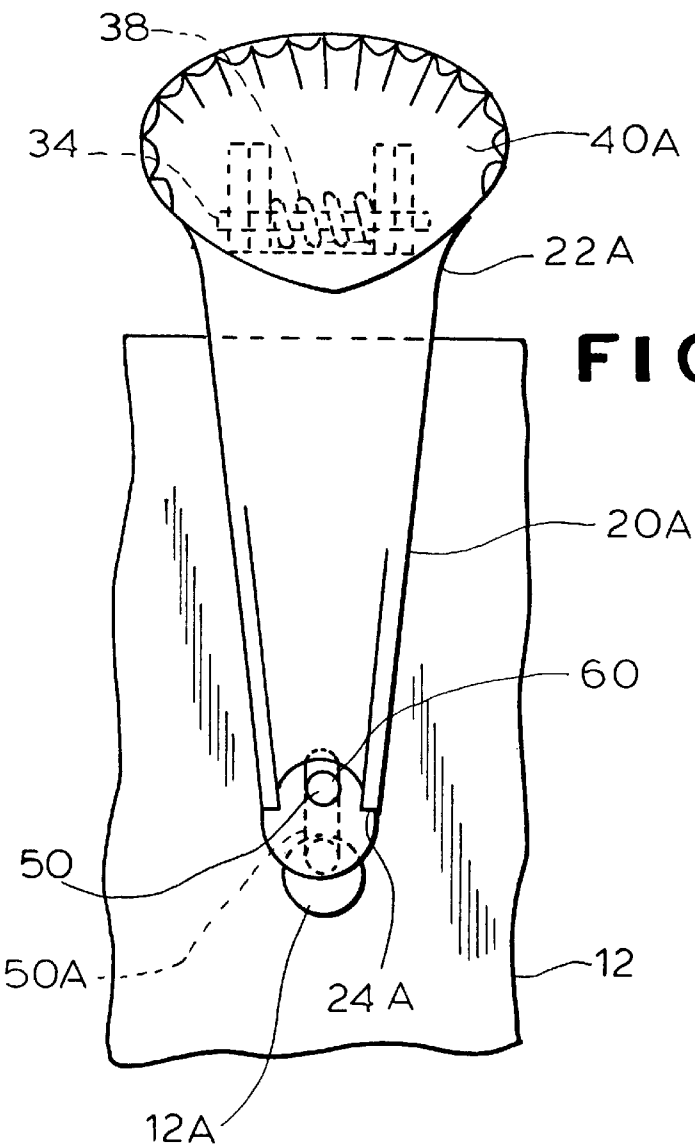

Referring now to the drawing, and in particular to FIG. 1 thereof, therein illustrated is a curtain clip according to the present invention, generally designated by the reference numeral 10, suspending an aperture curtain, generally designed 12, from an overhead curtain rod, generally designated 14. The curtain clip 10 slidably suspends, with like clips 10, the curtain 12 on the overhead curtain rod 14.

Figure 3:
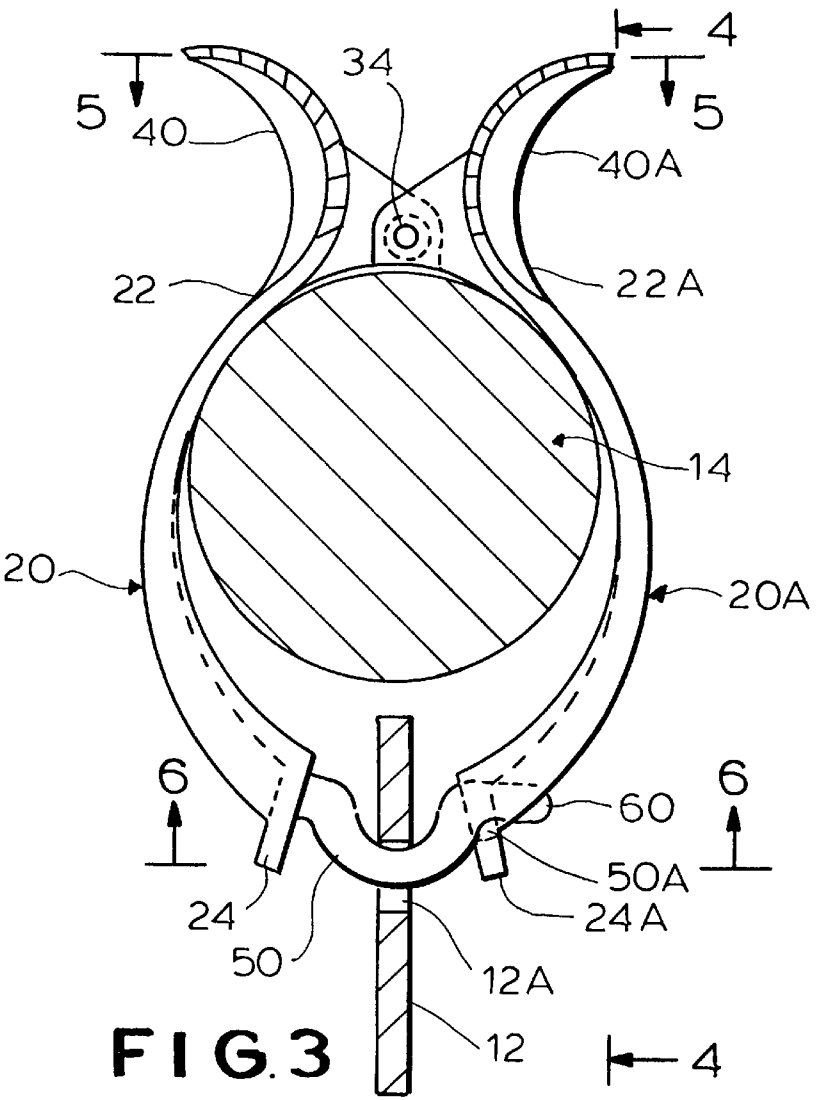
FIG. 3 is a side elevational view similar to FIG. 2, but showing the clip in the closed and locked orientation, supporting a fragmentarily indicated shower curtain.

Referring now to FIGS. 2–3 as well, the clip 10 comprises a pair of substantially rigid legs 20, 20A defining top ends 22, 22A and bottom ends 24, 24A. The legs 20, 20A are configured and dimensioned to extend cooperatively around the curtain rod 14, with at least one of the bottom ends 24, 25 extending through an aperture 12A in the curtain 12 for suspending the curtain 12 from the curtain rod 14 when the clip is in the closed orientation of FIG. 3.

Referring now in particular to FIG. 5, connecting means, generally designated 30, pivotally secure the legs 20, 20A together adjacent the top ends 22, 22A thereof. The connecting means 30 is illustrated as comprising a pair of arms 32 extending from the top end 22 of leg 20 towards the top end 22A of leg 20A, a pair of arms 32A extending from the top end 22A of leg 20A towards the top end 22 of leg 20, and a pivot rod 34 extending through each of the four arms 32, 32A to define a pivot axis. However, clearly other connecting means may be used.

Biasing means, generally designated 38, bias the bottom ends 24, 24A of the legs 20, 20A towards one another. The biasing means 38 may be a coiled spring, as illustrated in FIG. 5, or other biasing means well known in the mechanical arts. The biasing means of 38 is a desirable element of the clip because it renders the clip self-closing—that is, the user does not have to perform a special action in order to close the clip—however the biasing means 38 is not an essential component of the clip. For example, the clip without biasing means 38 may be manually closed by inward pressure on the legs 20, 20A pushing the bottom ends 24, 24A after the curtain aperture 12A has been disposed on the element 50 bridging the bottom ends 24, 24A.

Manually operable means, generally designated 40, 40A, are provided for overcoming the biasing means 38 in order to spread the bottom ends 24, 24A apart when the bottom ends 24, 24A are not locked together. As illustrated, the manually operable means 40, 40A are wings secured to or an integral part of the legs 20, 20A and extending outwardly above the pivot axis 34, although other opening means may be used instead. As best seen in FIG. 2, inwardly-directed manual pressure exerted on the wings 40, 40A brings them together (see arrows 42, 42A), thereby to cause the clip 10 to assume its open orientation (as illustrated in FIG. 2) if the bottom ends 24, 24A are not locked together. Movement of the curtain suspending the clip 10 from its closed orientation supporting a curtain 12 (illustrated in FIG. 3) to its open orientation releasing the curtain 12 (illustrated in FIG. 2) may be obtained by manual support of the curtain 12 so that it does not bear on the bottom ends 24, 24A of legs 20, 20A combined with manual pressure on wings 40, 40*a* in the direction of arrows 42, 42A.

Figure 7:
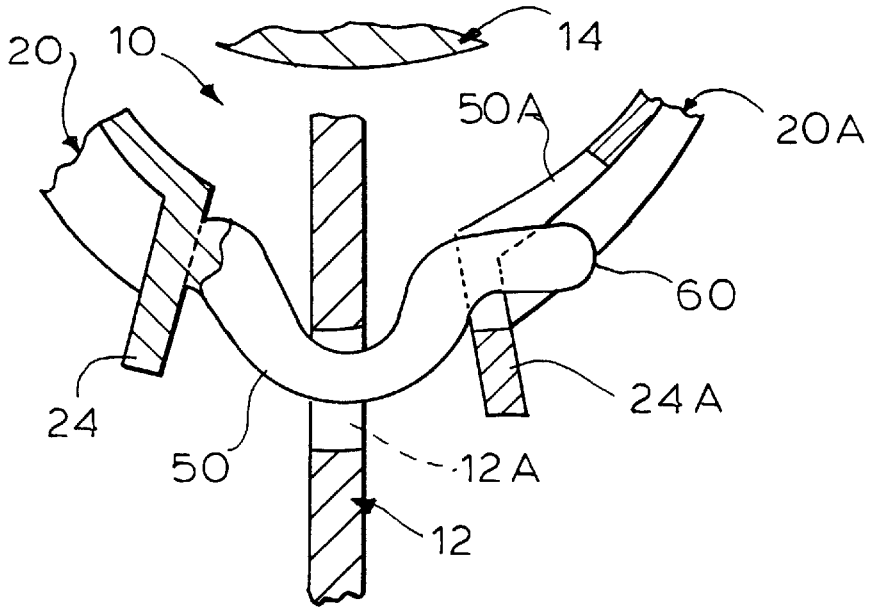
FIGS. 7 and 8 are fragmentary front elevational views, to an enlarged scale, showing the clip in a closed but unlocked orientation and a closed and locked orientation, respectively.
Figure 8:
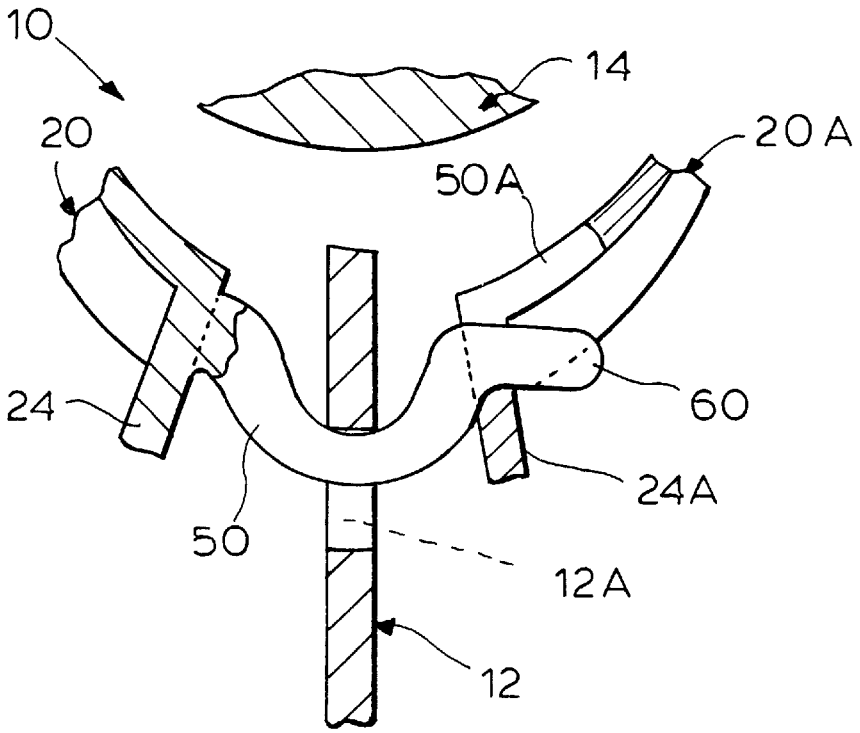

A critical feature of the present invention is the provision of means 50, 50A for locking the bottom ends of the legs 20, 20A together when the clip suspends a curtain 12 (see FIGS. 3 and 8), and for unlocking the bottom ends of legs 20, 20A when the clip 10 is not suspending a curtain 12 (see FIG. 7). To this end, one bottom end 20 defines a first engaging means 50, and the other bottom end 20A defines second engaging means, the biasing means 38 acting to inter-engage the first and second engaging means 50, 50A without locking the bottom ends together. More particularly, the first engaging means 50 is preferably a hook and the second engaging means 50A is preferably an eyelet, the biasing means 38 acting to cause the hook 50 to enter the eyelet 50A. As illustrated in FIG. 7, the first and second engaging means 50, 50A, and in particular the hook 50 and eyelet 50A, are configured and dimensioned such that the hook 50 engages the eyelet 50A in an unlocked orientation to enable easy manual separation of the hook 50 and eyelet 50A when the hook 50 is not bearing any weight. However, as illustrated in FIGS. 3 and 8, when the hook 50 bears the weight of its proportional share of a curtain 12 suspended therefrom, it engages the eyelet 50A in a locked orientation to preclude easy manual separation of the hook and eyelet. Broadly speaking, the proportional share of the weight of a curtain suspended from a series of clips is the full weight of the curtain divided by the number of clips.

Referring now to FIG. 3 in particular, in a preferred embodiment, the hook 50 is pivotally secured to one bottom end 24 for movement in a vertical plane relative to the one bottom end 50, such that in a locked orientation (FIGS. 3 and 8) the hook 50 is automatically locked together with the eyelet 50A and in an unlocked orientation (FIG. 7) the hook 50 is automatically unlocked and releasable from the eyelet 50A. To this end, according to the present invention, the hook 50 preferably is pivotable downwardly from the unlocked orientation (see FIG. 7) to the locked orientation (see FIG. 8) by the weight of its proportional share of a curtain 12 suspended therefrom. Thus, the free end 60 of the hook 50 is movable a vertically extending distance between an upper unlocked orientation (FIG. 7) and a lower locked orientation (FIG. 8). The hook 50 is resiliently flexible so that, in the absence of downward pressure thereon, it maintains or resumes its upper unlocked orientation.

The eyelet 50A is not movable relative to bottom end 24 of leg 20A. It will be appreciated, however, that the hook 50 is vertically pivotable only about its engagement with the bottom end 24 of leg 20, only along its length projecting outwardly from bottom end 24, or both. Indeed, alternate engaging means may be used (other than the hook and eyelet), provided that the engaging means automatically enters into a locked orientation under the weight of a proportional share of a curtain being suspended by the clip, and into an unlocked orientation when such weight is removed from the engaging means.

The automatic clip 10 of the present invention is susceptible of one-handed operation, as no special handling of the clip on the part of the user is required to lock or unlock the engaging means 50, 50A thereof. In order to apply the clip, one hand is used to place it in the open orientation by means of inward-directed manual pressure (see arrows 42, 42A) exerted by the one hand on the wings 40, 40A, thereby to enable it to be passed over a curtain rod 14. The other hand may position a curtain 12 such that one of its apertures 12A becomes occupied by the hook 50 when manual pressure on the wings 40, 40A is released and the clip closes under the influence of biasing means 38 (or, when biasing means 38 is not present, under manual pressure applied to the bottom ends 24, 24A). Similarly, in order to remove the clip 10, one hand is used to support the curtain 12 relative to the hook 50 so that the hook and eyelet assembly 50/50A becomes unlocked (because the hook 50 no longer bears its proportional share of the weight of the curtain 12), and the manual pressure (see arrows 42, 42A) exerted on the wings 40, 40A by the other hand is sufficient to overcome the influence of the biasing means 38.

The entire clip 10 may be formed exclusively of plastic although the biasing means 38 is preferably a metal spring.

The present invention further encompasses, in combination, a curtain clip 10, a curtain 12 and a curtain rod 14, and especially, in combination, a shower curtain clip, a shower curtain, and an overhead shower curtain rod.

While the present invention has been shown and described in the context of a shower curtain clip for suspending a shower curtain on an overhead shower curtain rod, the principles of the present invention are equally applicable to other curtain clips—for example, a partition curtain clip for slidably suspending, with like clips, an opaque partitioning curtain on an overhead partition curtain rod of the type used in hospitals to conceal one patient's bed from an adjacent patient's bed.

To summarize, the present invention provides a self-locking curtain clip for slidably suspending, with like clips, a curtain on an overhead curtain rod. In a preferred embodiment, the curtain clip is also self-unlocking. The curtain clip is simple and economical to manufacture, use and maintain, the clip being possessed of a long useful life.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A self-locking curtain clip for slidably suspending, with like clips, an aperture curtain on an overhead curtain rod, said clip comprising:

(A) a pair of substantially rigid legs defining top ends and bottom ends, said legs being configured and dimensioned to extend cooperatively around a curtain rod and through an aperture in a curtain for suspending the curtain from the rod;

(B) connecting means for pivotally securing said legs together adjacent said top ends;

(C) automatic means for locking said bottom ends together when said clip suspends a curtain and for unlocking said bottom ends when said clip is not suspending a curtain; and (D) manually operable means for spreading said bottom ends apart when said bottom ends are not locked together;

one of said bottom ends defining a hook as first engaging means, and the other of said bottom ends defining an eyelet as second engaging means; said hook, when bearing the weight of its proportional share of a curtain suspended therefrom, engaging said eyelet in a locked orientation to preclude easy manual separation of said hook and said eyelet, and, when not bearing such weight, engaging said eyelet in an unlocked orientation to enable easy manual separation of said hook and said eyelet.

2. The clip of claim 1 wherein said hook is pivotally secured to said one bottom end for movement in a vertical plane relative to said one bottom end such that in a locked orientation said hook is locked together with said eyelet, and in an unlocked orientation said hook is unlocked and releasable from said eyelet.

3. The clip of claim 2 wherein said hook is pivotal from said unlocked orientation to said locked orientation by the weight of its proportional share of a curtain suspended therefrom.

4. The clip of claim 3 wherein a free end of said hook is movable a vertically extending distance between an upper unlocked orientation and a lower locked orientation.

5. The clip of claim 4 wherein said hook is resiliently flexible and, in the absence of pressure thereon, maintains said upper unlocked orientation.

6. The clip of claim 1 additionally including biasing means for biasing said bottom ends towards one another.

7. The clip of claim 1 additionally including biasing means for inter-engaging said first and second engaging means without locking said bottom ends together.

8. The clip of claim 1 additionally including biasing means for causing said hook to enter said eyelet.

9. A self-locking curtain clip for slidably suspending, with like clips, an aperture curtain on an overhead curtain rod, said clip comprising:

(A) a pair of substantially rigid legs defining top ends and bottom ends, said legs being configured and dimensioned to extend cooperatively around a curtain rod and through an aperture in a curtain for suspending the curtain from the rod, one of said bottom ends defining a hook and the other of said bottom ends defining an eyelet, said hook, when bearing the weight of its proportional share of a curtain suspended therefrom, engaging said eyelet in a locked orientation to preclude easy manual separation of said hook and said eyelet, and, when not bearing such weight, engaging said eyelet in an unlocked orientation to enable easy manual separation of said hook and said eyelet;

(B) connecting means for pivotally securing said legs together adjacent said top ends;

(C) biasing means for biasing said bottom ends towards one another, said biasing means acting to inter-engage said hook and eyelet by causing said hook to enter said eyelet without locking said bottom ends together;

(D) automatic means for locking said bottom ends together when said clip suspends a curtain and for unlocking said bottom ends when said clip is not suspending a curtain; and (E) manually operable means for overcoming said biasing means to spread said bottom ends apart when said bottom ends are not locked together.

10. The clip of claim 9 wherein said hook is pivotally secured to said one bottom end for movement in a vertical plane relative to said one bottom end such that in a locked orientation said hook is locked together with said eyelet, and in an unlocked orientation said hook is unlocked and releasable from said eyelet, said hook being pivotal from said unlocked orientation to said locked orientation by the weight of its proportional share of a curtain suspended therefrom, a free end of said hook being movable a vertically extending distance between an upper unlocked orientation and a lower locked orientation, said hook being resiliently flexible and, in the absence of pressure thereon, maintaining said upper unlocked orientation.

11. The clip of claim 10 wherein said curtain clip is a shower curtain clip for slidably suspending, with like clips, a shower curtain on an overhead shower curtain rod.

12. In combination, the clip of claim 9, a curtain and a curtain rod.

13. In combination, the clip of claim 11, a shower curtain and an overhead shower curtain rod.

* * * * *